US010687569B1

(12) United States Patent
McDirmid

(10) Patent No.: US 10,687,569 B1
(45) Date of Patent: Jun. 23, 2020

(54) FACE MASK

(71) Applicant: TheHuna LLC, Spokane, WA (US)

(72) Inventor: Jessie McDirmid, Spokane, WA (US)

(73) Assignee: TheHuna LLC, Spokane, WA (US)

( * ) Notice: Subject to any disclaimer, the term of this patent is extended or adjusted under 35 U.S.C. 154(b) by 245 days.

(21) Appl. No.: 15/938,714

(22) Filed: Mar. 28, 2018

(51) Int. Cl.
*A41D 13/11* (2006.01)
*A42B 3/20* (2006.01)

(52) U.S. Cl.
CPC ..... *A41D 13/1161* (2013.01); *A42B 3/20* (2013.01); *A41D 2300/32* (2013.01); *A41D 2400/10* (2013.01); *A41D 2600/10* (2013.01)

(58) Field of Classification Search
CPC ..... A41D 13/1161; A41D 13/11; A41D 13/1153; A42B 1/067; A42B 1/066; A42B 3/18; A42B 3/20
USPC ..... 2/175.6, 246, 209.13, 424
See application file for complete search history.

(56) References Cited

U.S. PATENT DOCUMENTS 2,055,560 A * 9/1936 Rose ..... A42B 1/067 2/172
3,373,443 A * 3/1968 Marietta ..... A42B 3/20 2/424
3,787,895 A * 1/1974 Belvedere ..... A42B 3/08 2/9
3,815,152 A * 6/1974 Bednarczuk ..... A42B 3/069 2/9
3,889,296 A * 6/1975 Martin ..... A42B 3/20 2/9
3,897,598 A * 8/1975 Bednarczuk ..... A42B 3/20 2/9
4,031,567 A * 6/1977 Planck ..... A42B 1/041 2/204
4,632,389 A * 12/1986 Moss ..... A42B 1/24 128/DIG. 15
4,764,990 A 8/1988 Markert
5,035,004 A * 7/1991 Koester ..... A42B 1/004 2/10
5,046,195 A * 9/1991 Koritan ..... A41D 13/0512 2/172
5,062,157 A * 11/1991 Muta ..... A41D 20/00 2/171
5,121,507 A * 6/1992 Brown ..... A42B 1/004 2/10
5,153,943 A * 10/1992 Clement ..... A42B 1/067 2/172
5,161,259 A * 11/1992 Shorts ..... A42B 1/067 2/171
5,212,837 A * 5/1993 Gose ..... A42B 1/067 2/172

(Continued)

*Primary Examiner* — Heather Mangine
(74) *Attorney, Agent, or Firm* — Lee & Hayes, P.C.

(57) ABSTRACT

A system including a first band and a second band that have a first side with a first attachment mechanism and a second attachment mechanism and a second side with a third attachment mechanism. The first attachment mechanism may engage with the third attachment mechanism. The system may also include a face mask with a first side and a second side having at least a fourth attachment mechanism and a fifth attachment mechanism. The fourth attachment mechanism may engage with the second attachment mechanism of the first band while the fifth attachment mechanism may engage with the second attachment mechanism of the second band.

10 Claims, 11 Drawing Sheets

(56) References Cited

U.S. PATENT DOCUMENTS 5,231,704 A * 8/1993 Hildenbrand ..... A42B 3/163 2/209
5,355,535 A * 10/1994 Bruder ..... A42B 1/067 2/172
5,381,559 A * 1/1995 Wakefield, III ..... A42B 1/066 2/172
5,400,440 A * 3/1995 Clifford ..... A42B 1/067 2/172
5,424,787 A * 6/1995 Zegarelli ..... A41D 13/1161 2/429
5,428,844 A * 7/1995 Dougherty ..... A42B 1/248 2/181
5,467,765 A * 11/1995 Maturaporn ..... A41D 13/1115 128/206.12
5,499,402 A * 3/1996 Rose ..... A42B 1/248 2/181.4
5,502,843 A * 4/1996 Strickland ..... A42B 3/20 2/424
5,517,695 A * 5/1996 Murray ..... A42B 1/248 2/181.4
5,519,892 A * 5/1996 Pizzacar ..... A42B 1/248 2/181
5,546,605 A * 8/1996 Mallardi ..... A42B 1/22 2/181
5,575,009 A * 11/1996 Ryvin ..... A41D 13/1153 2/173
5,603,117 A * 2/1997 Hudner, Jr. ..... A42B 3/127 2/423
5,617,584 A * 4/1997 Brennan ..... A41D 13/11 2/172
5,628,308 A * 5/1997 Harges, Jr. ..... A41D 13/1153 128/201.25
5,655,225 A * 8/1997 Mathers ..... A42B 1/067 2/172
5,666,668 A * 9/1997 Ronquillo ..... A42B 1/041 2/171
5,685,017 A * 11/1997 Kraft ..... A42B 1/067 2/10
5,704,063 A 1/1998 Tilden
5,704,068 A * 1/1998 Martin ..... A41D 13/1153 128/201.13
5,706,804 A * 1/1998 Baumann ..... A41D 13/1115 128/206.12
5,713,077 A * 2/1998 Humbrecht ..... A41D 13/1153 2/108
5,737,777 A * 4/1998 Hilleary ..... A42B 3/08 2/421
5,845,340 A * 12/1998 Frislie ..... A41D 13/1153 2/202
5,862,524 A * 1/1999 Case ..... A42B 1/24 2/209.13
5,926,854 A * 7/1999 Grilliot ..... A61F 9/025 2/422
5,953,761 A * 9/1999 Jurga ..... A42B 3/145 2/414
6,006,362 A * 12/1999 Walsh ..... A42B 1/248 2/181
6,021,525 A * 2/2000 Mertins ..... A42B 1/067 2/172
6,032,292 A * 3/2000 Wood ..... A41D 23/00 2/206
6,048,810 A * 4/2000 Baychar ..... A41D 27/02 36/117.3
6,145,504 A * 11/2000 Miyake ..... A41D 13/11 128/206.19
6,279,168 B1 * 8/2001 Bean ..... A42B 1/248 2/195.1
6,298,483 B1 * 10/2001 Schiebl ..... A42B 3/0433 2/421
6,438,760 B1 * 8/2002 Wakefield ..... A42B 1/004 2/209.13
6,634,031 B1 * 10/2003 Schlapkohl ..... A42B 1/242 2/209.13
6,644,807 B1 * 11/2003 Hood ..... A42B 1/247 2/10
6,792,619 B1 * 9/2004 Morris ..... A42B 1/247 2/10
6,804,829 B2 10/2004 Crye et al.
6,857,134 B1 * 2/2005 Cowell ..... A42C 5/04 2/209.13
6,862,750 B1 * 3/2005 Rasberry ..... A42B 3/08 2/421
7,093,302 B1 8/2006 Burns
7,131,148 B1 * 11/2006 Traumer ..... A42B 1/041 2/426
7,216,972 B1 * 5/2007 Gelfuso ..... A42B 1/247 2/10
7,275,269 B2 10/2007 Skillman
7,308,721 B1 * 12/2007 Rivera, Jr. ..... A41D 13/1153 2/207
7,310,829 B1 * 12/2007 Engel-Wilson ..... A42B 1/067 2/175.6
7,631,365 B1 * 12/2009 Mahan ..... A42B 3/20 2/6.6
8,024,818 B1 * 9/2011 Davenport ..... A42B 1/067 2/172
8,185,969 B2 * 5/2012 Chang ..... A41D 23/00 2/206
8,918,916 B1 * 12/2014 Kang ..... A42B 1/067 2/171
9,095,182 B1 * 8/2015 Rochholz ..... A42B 3/08
9,521,873 B1 * 12/2016 Mignone ..... A41D 13/1161
2004/0058102 A1 * 3/2004 Baychar ..... A43B 5/0405 428/34.1
2004/0139530 A1 * 7/2004 Yan ..... A42B 1/067 2/209.13
2005/0229291 A1 10/2005 Gendall
2005/0279786 A1 * 12/2005 Gac ..... A42B 1/24 224/181
2006/0090245 A1 * 5/2006 McGhee ..... A42B 1/041 2/206
2006/0117450 A1 * 6/2006 Matsumoto ..... A42B 1/12 2/10
2006/0212996 A1 * 9/2006 McGrath ..... A41D 13/1161 2/207
2007/0089219 A1 * 4/2007 Trainor ..... A42B 3/08 2/421
2008/0066214 A1 * 3/2008 O'Hare ..... A41D 13/1153 2/172
2008/0127400 A1 6/2008 Dupuis
2009/0320172 A1 12/2009 Slate et al.
2010/0011488 A1 * 1/2010 Sutton ..... A42B 1/067 2/412
2010/0107318 A1 * 5/2010 Asta ..... A42B 3/105 2/424
2010/0205707 A1 8/2010 Mahan
2011/0179540 A1 * 7/2011 Sutton ..... A41D 13/1107 2/9
2011/0180078 A1 * 7/2011 McKinley ..... A41D 13/1161 128/863
2011/0247120 A1 * 10/2011 Knoedler ..... A42B 1/247 2/10
2012/0030859 A1 * 2/2012 Kroese ..... A41D 13/1161 2/207
2012/0192333 A1 * 8/2012 Thompson ..... A41D 27/13 2/69
2012/0216340 A1 * 8/2012 Asta ..... A42B 3/105 2/422
2012/0272483 A1 * 11/2012 Moore ..... A42B 1/247 24/3.3
2013/0014316 A1 1/2013 Castro et al.
2014/0013485 A1 * 1/2014 Parker ..... A42B 1/067 2/172
2014/0182602 A1 * 7/2014 Nagao ..... A41D 13/1161 128/863
2014/0245524 A1 9/2014 Stephens

(56) References Cited

U.S. PATENT DOCUMENTS

| | | | | |
|---|---|---|---|---|
| 2014/0259253 | A1* | 9/2014 | Jacob | A41D 13/1161 2/15 |
| 2014/0259319 | A1* | 9/2014 | Ross | A42B 3/18 2/424 |
| 2014/0317835 | A1* | 10/2014 | Mejia, Jr. | A42B 3/20 2/424 |
| 2014/0331393 | A1* | 11/2014 | DaSilva | A42B 3/08 2/414 |
| 2015/0059054 | A1* | 3/2015 | Peterson | A42B 1/067 2/172 |
| 2015/0074879 | A1* | 3/2015 | Hillion | A42B 3/105 2/424 |
| 2015/0113711 | A1* | 4/2015 | Kim | A42B 1/046 2/424 |
| 2015/0230533 | A1* | 8/2015 | Bancroft | A42B 3/20 2/424 |
| 2015/0351468 | A9 | 12/2015 | Chinquee | |
| 2016/0000167 | A1* | 1/2016 | Alley | A42B 3/22 2/412 |
| 2017/0055597 | A1* | 3/2017 | Lekven | A41D 1/04 |
| 2017/0079359 | A1* | 3/2017 | Chase | A42B 1/066 |
| 2017/0145596 | A1* | 5/2017 | Hays | A41D 31/28 |
| 2017/0156433 | A1* | 6/2017 | Chen | A41D 27/00 |
| 2017/0196280 | A1* | 7/2017 | Murphy | A41D 13/1153 |
| 2017/0224041 | A1* | 8/2017 | Lovell | A42B 1/12 |
| 2017/0347730 | A1* | 12/2017 | Baychar | B32B 27/12 |
| 2017/0360121 | A1* | 12/2017 | Hamilton | F21V 33/0076 |
| 2018/0084856 | A1* | 3/2018 | Lee | A42B 1/248 |
| 2018/0185733 | A1* | 7/2018 | King | A63B 71/10 |

* cited by examiner

FACE MASK

BACKGROUND

When engaging in outdoor activities such as snowboarding, skiing, sledding, snowmobiling, snowshoeing, and the like, people often wear cold-weather gear such as jackets, pants, or sweaters to keep warm. However, these garments often fail to insulate or protect a person's neck and/or face. In extreme environments, these body parts may become even colder due to their exposure to wind or the person moving throughout the cold environment.

To protect against such weather, people may wear various accessories such as ski masks or scarves. However, these types of neckwear typically lack versatility and may be awkward to use. For instance, while these garments may help to warm up or protect exposed areas from the cold, they are often tied or wrapped around the neck and create excess tails or a bulky tie section. In addition, scarves or masks may leave some of the neck exposed and may require constant readjustment. Furthermore, conventional masks are not easily removable, adjustable, or configurable to or with existing equipment, such as a helmet or other headgear. As a result, conventional neckwear fails to adequately protect a person's neck and/or face from cold weather in a convenient way.

BRIEF DESCRIPTION OF THE DRAWINGS

The detailed description is described with reference to the accompanying figures. In the figures, the left-most digit(s) of a reference number identifies the figure in which the reference number first appears. The same reference numbers in different figures indicate similar or identical items.

DETAILED DESCRIPTION

Figure 1:
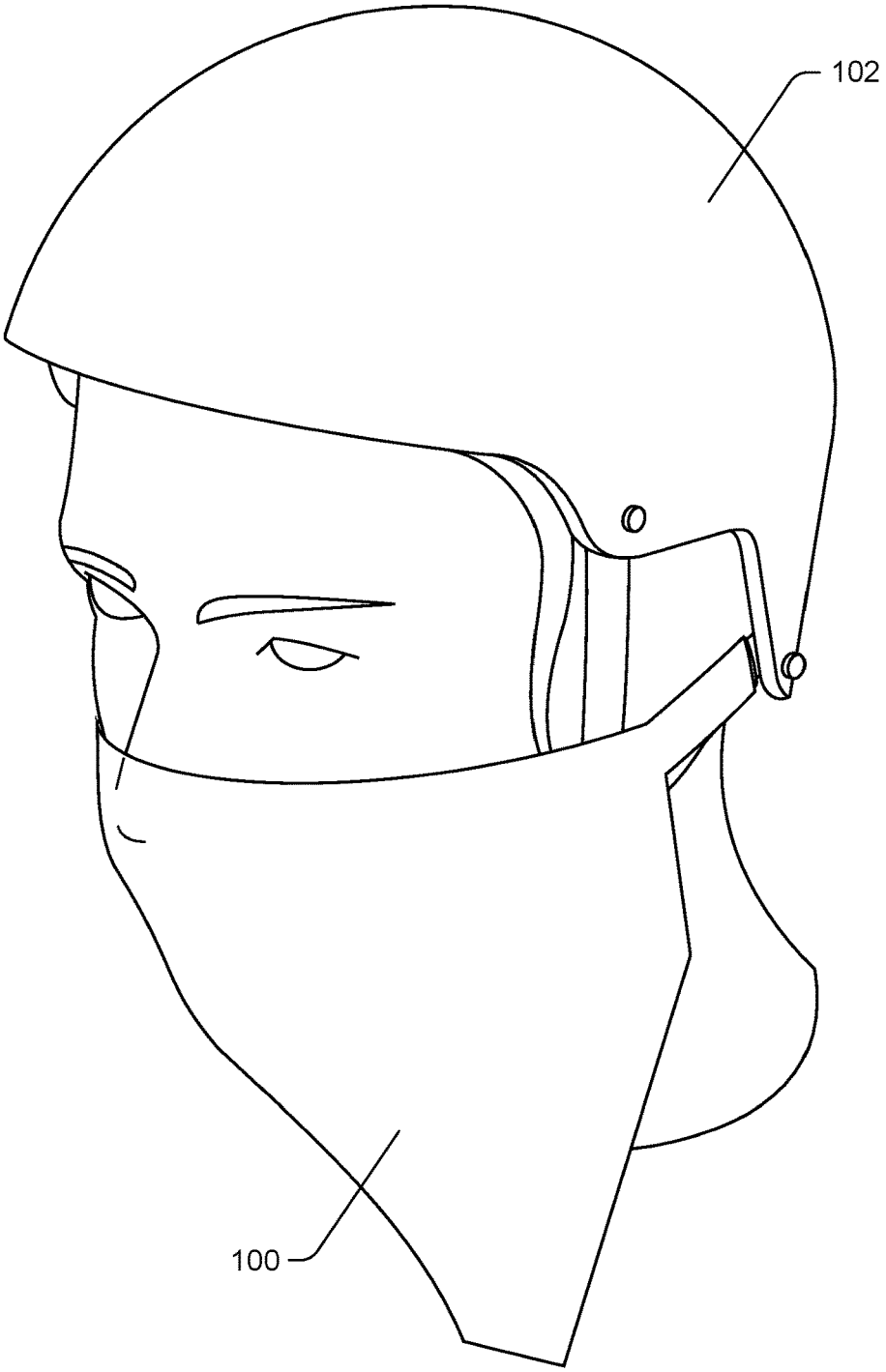
FIG. 1 is perspective view of a user wearing an example face mask.

As discussed above, existing ski masks, or other neck garments, fail to adequately protect against cold weather. Existing ski masks may also lack universal use or may be difficult to use in conjunction with other garments. For instance, as ski masks often wrap around or tie to a user's neck or head, when used with a helmet, the ski mask may require constant readjustment or positioning. Moreover, it is often cumbersome and a hassle to quickly remove and attach ski masks when wearing a helmet. Yet still, existing ski masks may bunch around a user's neck, creating a bulky feel or appearance, or may act as a trap for condensation.

In light of the above deficiencies, this application describes a gaiter or a face mask that may be used in conjunction with a helmet. In instances, the face mask may easily and conveniently attach and detach to the helmet without the need to reach around one's neck to unbuckle, unstrap, or untie the face mask. Compared to conventional ski masks or other neckwear, face masks according to this application may not require constant repositioning or adjustment via a helmet interfering with the attachment of the ski mask. Instead, face masks according to this application may compactly cover a user's neck or face without creating a bulky feel and/or appearance. In addition, the face masks may be versatile and may be used with a wide range of helmet designs and configurations to provide a universal garment to warm and protect users from cold weather.

In instances, face masks according to this application may include a gaiter, warmer, or mask that attaches to a helmet via a belt, fastener, or band(s) that wraps around or couples to a strap(s) of the helmet. In instances, the band may include a substrate or piece of material that is configured to encase or fold around the strap of the helmet. In turn, the face mask may couple to the band via an attachment with the band. For instance, the band may wrap around respective straps disposed on either side of a buckle or D-ring of the helmet.

To couple the band to the helmet, the band may have one or more attachment mechanisms. For instance, on a first side of the band, there may be one or more attachment mechanisms that, when the band is folded, couple or engage with one or more attachment mechanisms on a second side of the band. The engagement between the one or more attachment mechanisms on the first side and the one or more attachment mechanisms on the second side may hold an arrangement or configuration of the band in a folded position. That is, when the band wraps around the strap of the helmet, the engagement between the one or more attachment mechanisms may prevent the band from unraveling, unwrapping, or otherwise separating. The engagement between the one or more attachment mechanisms on the first side and the second side may therefore secure and couple the band to a strap of the helmet. In instances, the attachment mechanisms may include a hook-and-loop attachment means, which may be, for example, VELCRO™, made and manufactured by The 3M Company of Maplewood, Minn. Additionally, or alternatively, the one or more attachment mechanisms on the bands may include attachment mechanisms such as magnets, hooks, loops, clips, buckles, hangers, zippers, buttons, and/or the like.

As will be discussed herein, more than one band may be used on respective sides of the helmet or on respective straps of the helmet.

In instances, depending on the tautness or tightness the band is coupled to the strap, the band may slide upward or downward along the strap or may rotate about the strap. That is, the band may be cinched or clutched to strap, either loosely or firmly, so as to secure the band to the strap. In doing so, and depending on the coupling, the band may be repositioned on or around the strap or may be slid into positions beneath ear warmers, other straps, padding, and/or insulation on the helmet. As such, in instances, the band may have a length that is smaller than a length of the strap in order to allow the band to traverse or move along a length of the strap.

The face mask may include one or more attachment mechanisms that couple to the one or more attachment mechanisms of the bands. In turn, given that the bands may couple to the helmet via the straps, the interaction between the one or more attachment mechanisms on the face mask and the one or more attachment mechanisms on the band may secure and couple the face mask to the helmet. In instances, the one or more attachment mechanisms on the face mask may include attachment mechanisms such as magnets, Velcro, hooks, loops, clips, buckles, hangers, zippers, buttons, and/or the like. To permit coupling of the face mask to the helmet, the one or more attachment mechanisms on the face mask may be complimentary to engage the attachment mechanisms on the bands. For instance, a loop mechanism on the band may couple to a hook mechanism on the face mask, creating a hook-and-loop interaction.

In instances, the face mask may include multiple layers that insulate, protect, warm, or shield a user's neck from cold weather. The multiple layers may include or have different purposes or functions, such as providing breathability, water resistance, and/or comfort. For instance, a layer immediately adjacent or nearest to a user's face may include a breathable material while an exterior layer of the face mask furthest away from the user may include a waterproof or water-resistant material. The materials of the face mask may also be made from washable materials that may withstand the environment of washing machines.

The face mask may include various designs that conveniently and compactly wear around a user's neck to protect the user from cold weather. For instance, the face mask may include tapers, radiuses, or chamfers that conform or shape the face mask to the neck or face. As a result, the face mask may lay flat around or follow contours of a user's neck and/or may reduce excess material that creates discomfort or a bulky appearance. In addition, portions of the face mask may conveniently tuck into or attach to other garments in order to limit the face mask flapping or thrashing about while in use by the user.

Moving to the specifics of the coupling of the face mask to the helmet, depending on the one or more attachment mechanisms of the bands and/or the face mask, respectively, the face mask may be pressed, pinched, zipped, clipped, Velcroed or otherwise brought into contact with the band. As noted above, once the band is coupled to the straps of the helmet, the face mask may couple to the helmet via an engagement with the band. By way of a non-limiting example, the attachment mechanism on the band may include a loop substrate while the face mask may include a hook substrate. Through bringing the face mask and band into contact, the loop substrate and the hook substrate may interact to attach the band and the face mask, via a hook-and-loop coupling. In instances, the one or more attachment mechanisms on the face mask may be included on a first side of the face mask that faces the user while an opposing second side may outwardly face the user.

The one or more attachment mechanisms on the face mask may be brought into contact with the one or more attachment mechanisms on the bands and in doing so, the engagement between the one or more attachment mechanisms on the bands and the face mask may secure the face mask to the helmet. When the face mask attaches to the helmet, the face mask may extend, span, or stretch across the face of a user. In addition, sides of the face mask may hang or cover the mouth, nose, ear, or neck.

To remove the face mask from the helmet, portions of the face mask may be pulled or separated from the band(s). For instance, in some examples, the face mask may include tabs or flanges that permit the face mask to be easily grasped and removed from the helmet. In instances, only a portion of the face mask may be separated from the bands. For instance, the face mask may have a first attachment mechanism that attaches to a first attachment mechanism on a first band and a second attachment mechanism that attaches to a first attachment mechanism on a second band. As noted above, in instances, the first band and the second band may attach to separate straps located on opposing sides of the helmet. Therefore, one of the first attachment mechanism or second attachment mechanism may be separated from the first band or the second band, respectively, such that the face mask may hang or suspend from a remaining attachment between one of the first band or the second band. In instances, this may allow the user to speak to others, for instance, without the need to completely detach the face mask from the helmet. The hanging or detached end of the face mask may thereafter be easily reattached to its respective band.

Accordingly, compared to conventional ski masks, neckwear, or neck warmers that must be tied, snapped, or buckled around a user's neck, thereby making the ski masks susceptible to loosening when used in conjunction with helmets, face masks according to this application may provide a convenient garment that comfortably and conveniently protects and shields a user's neck without the need for constant readjustment or repositioning.

Moreover, although this application discusses the face mask in use with a ski helmet, the face mask may be used with other helmets, such as motorcycle helmets or bike helmets, or may be used with hats, beanies, or other head garments that include straps or points about which the band(s) may couple.

FIG. 1 illustrates a face mask 100 coupled to a helmet 102 worn by a user. As discussed in detail herein, the face mask 100 may couple to the helmet 102 via a band that wraps around a strap of the helmet 102. The strap of the helmet 102 may correspond to a buckle strap or other straps that are used to secure the helmet 102 to the user. In instances, the band may fold or wrap around the strap to secure the band to the helmet 102. Thereafter, the face mask 100 may couple to the band to secure the face mask 100 to the helmet 102. In instances, the face mask 100 may couple to the band via attachment mechanisms located on the face mask 100 and on the band, respectively. That is, the engagement between an attachment mechanism on the face mask 100 and an attachment mechanism on the band may couple the face mask 100 to the helmet 102.

After coupling to the helmet 102, the face mask 100 may hang or otherwise suspend from the helmet 102. As shown in FIG. 1, portions of the face mask 100 may cover and/or shield the face and/or neck of the user wearing the helmet 102. Portions of the face mask 100 may also tuck into or attach to other garments, such as a jacket or sweater worn by the user.

In instances, the face mask 100 may include multiple layers that are sewn or attached together. For instance, the face mask 100 may include layers that are washable, breathable, permeable, impermeable, durable, or water-resistant. By way of example, the face mask may include at least four layers, where a first layer closest to the user draws moisture away from the body and/or absorbs little moisture. In examples, the first layer may include permeable or breathable materials such as polyester or polyester blends. The second later, which may be adjacent to the first layer, may include a cotton material that is breathable. The third layer, which may be adjacent to the second layer, so as to interpose the second layer between the first layer and the third layer, may be a woven, knitted, or sewn fabric, such as cotton, nylon, wool, silk, or other threads. In instances, the third layer may provide structure or rigidity to the face mask 100. The fourth layer, which may sandwich the third layer between the second layer and the fourth layer, may include water resistant or waterproof materials such as nylon or polyester, or may include other materials that are coated and/or treated with water resistant sprays or chemicals.

As will be discussed herein, face masks according to this application may take or include other designs or profiles than that shown in FIG. 1.

Figure 2:
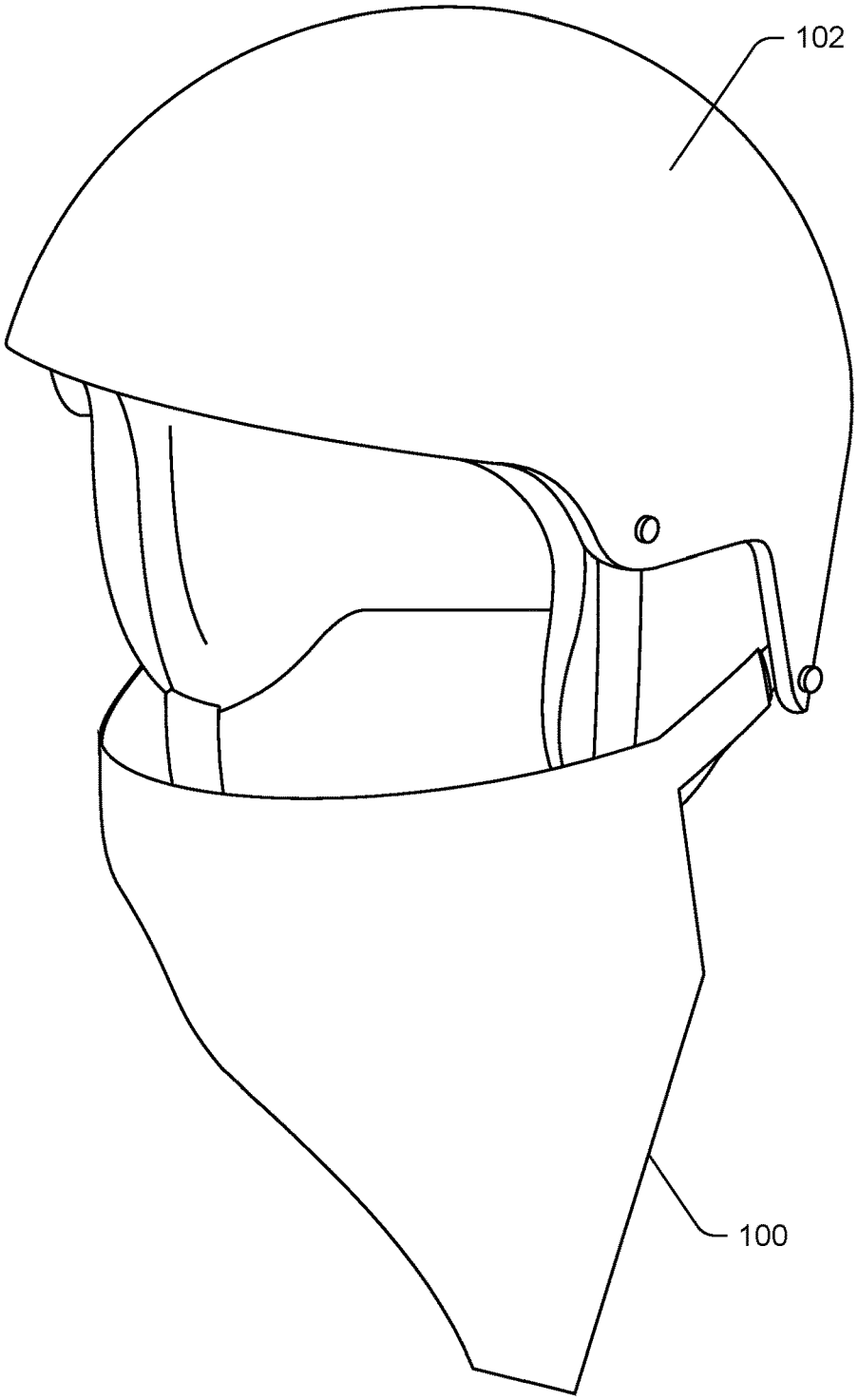
FIG. 2 is a perspective view the example face mask of FIG. 1, showing both sides of a face mask attached to a helmet.

FIG. 2 illustrates the face mask 100 coupled to the helmet 102. To couple the face mask 100 to the helmet 102, opposing ends or sides of the face mask 100 may couple to respective bands that are wrapped around straps of the helmet 102. For instance, one end of the face mask 100 may attach to a first band while an opposite or different end of the face mask 100 may attach to a second band. The first band and the second band may be disposed on opposing sides of the helmet 102. Therefore, the face mask 100 may have two attachment points to the helmet 102 so as to span across the neck and/or face of a user.

Figure 3:
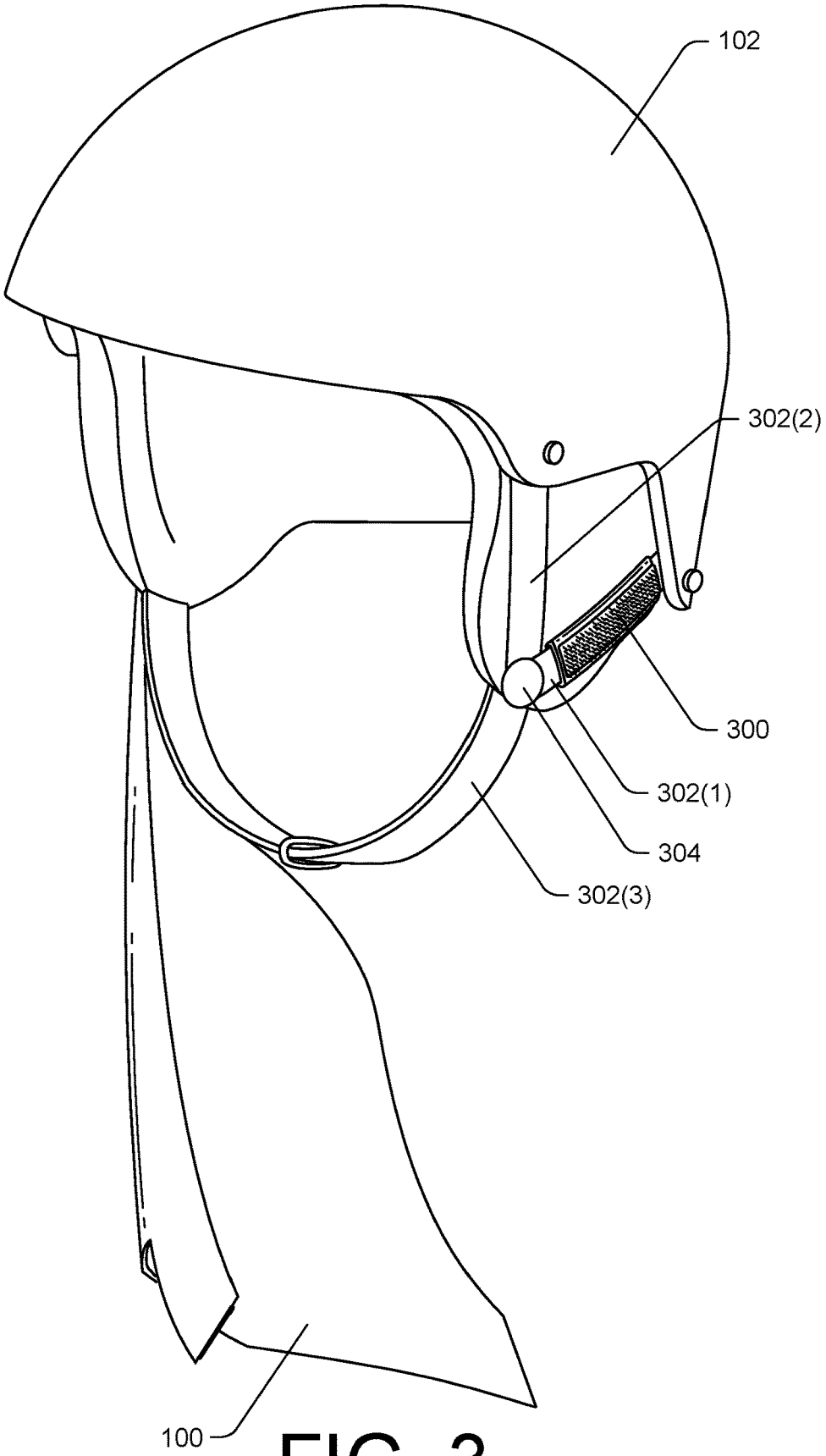
FIG. 3 is a perspective view of the example face mask of FIG. 1, showing one side of a face mask attached to the helmet.

FIG. 3 illustrates one end of the face mask 100 coupled to the helmet 102 while an opposite end is suspended. As mentioned above, the face mask 100 may couple to the helmet 102 via a band 300 that wraps around straps 302(1), 302(2), and 303(3) (collectively the "strap 302") of the helmet 102. In examples, the helmet may have more than one band 300, such as a first band or second band, located on opposite sides of the helmet. In instances, the band 300 may couple about one of the straps 302(1), 302(2), or 303(2). By way of an example, the band 300 may be located higher up on the helmet 102, such as being wrapped around strap 302(2). In this instance, the face mask 100 may cover or shield different portions of the user's nose, cheeks, mouth, and/or chin. That is, although FIG. 3 illustrates the band 300 coupling to the strap 302(1), the band 300 may couple to any of the straps 302(1), 302(2), and 302(3). Yet still, in stances, the band 300 may couple to one or more of the strap 302(1), the strap 302(2), or the strap 302(3). In doing so, the band 300 may be disposed on the helmet 102 to adjust the coverage of the face mask 100.

In instances, the straps 302(1), 302(2), and 302(3) may be connected by or about a connector 304.

While FIG. 3 illustrates a particular arrangement or disposition of the strap 302, or the straps 302(1), 302(2), and 303 on the helmet 102, in instances, other helmets may include straps comparable or different than those shown in FIG. 3. For instance, other helmets may include less or more straps and may attach to helmets at different positions, orientations, or locations than shown in FIG. 3.

In instances, after wrapping around the strap 302, the band 300 may slide along a length of the strap 302. Additionally, or alternatively, the band 300 may rotate about the strap 302. In doing so, through sliding or rotating the band 300, an orientation or position of the band 302 on the helmet 102 may be altered. Moreover, discussed in more detail herein, the tautness at which the band 300 is secured to the strap 302 may be adjusted.

Moreover, a slack or tautness of the face mask 100 across the user may be adjusted through the face mask 100 attaching at various positions along the band 300. That is, the attachment mechanism on the face mask 100 may couple to the attachment mechanism on the band 300 at various positions along a length of the band 300. In addition, while the band 300 is shown as having respective lengths or widths relative to the face mask 100, the helmet 102, and/or the strap 302, in instances, the band 300 may have different lengths or widths than those illustrated in FIG. 3.

In instances, the straps 300 may be disposed on opposing sides of the helmet 102. That is, a first band and a second band may be disposed on an opposing strap 302 of the helmet 102 or on opposing sides of the helmet 102 that are capable of being buckled or snapped together in order to secure the helmet 102 to the user. Accordingly, one end of the face mask 100 may remain attached to the helmet 102, via the first band disposed on a first strap on one side of the helmet 102, for instance, while another end of the face mask 100 may be detached from the second band disposed on a second strap on another side of the helmet 102. The attachment between the face mask 100 and the first band, for instance, may support the face mask 100 so as to keep the face mask 100 attached to the helmet 102. In instances, the ends of the face mask 100 may detach from either the first band or the second band via pulling on the face mask 100 or portions thereof. In instances, this partial decoupling of the face mask 100 may allow the user to conveniently remove the face mask on one side to talk with others or eat, for instance, without losing or misplacing the face mask 100. As such, the face mask 100 may be accessibly removed from the helmet 102 and may not require the user to untie the face mask 100 or uncomfortably reach around the user's head or neck. Rather, removing the face mask 100 may be accessible on a front of the helmet 102, as shown in FIG. 3, for instance, in order to provide quick and easy access to both remove and attach the face mask 100.

In instances, given that the band 300 may be adjusted along or disposed along the strap 302 at different position, which may touch or otherwise contact the user, the band 300 may include materials that create a soft or non-abrasive interface between the band 300 and the user, such as felt, cotton, or leather.

Additionally, while the band 300 has been discussed as wrapping around the strap 302, in some instances, the band 300 may couple to the strap 302 or other parts of the helmet in different manners. For instance, the band 300 may snap to the helmet 102 or may be coupled to the helmet 102 using adhesives.

Figure 4:
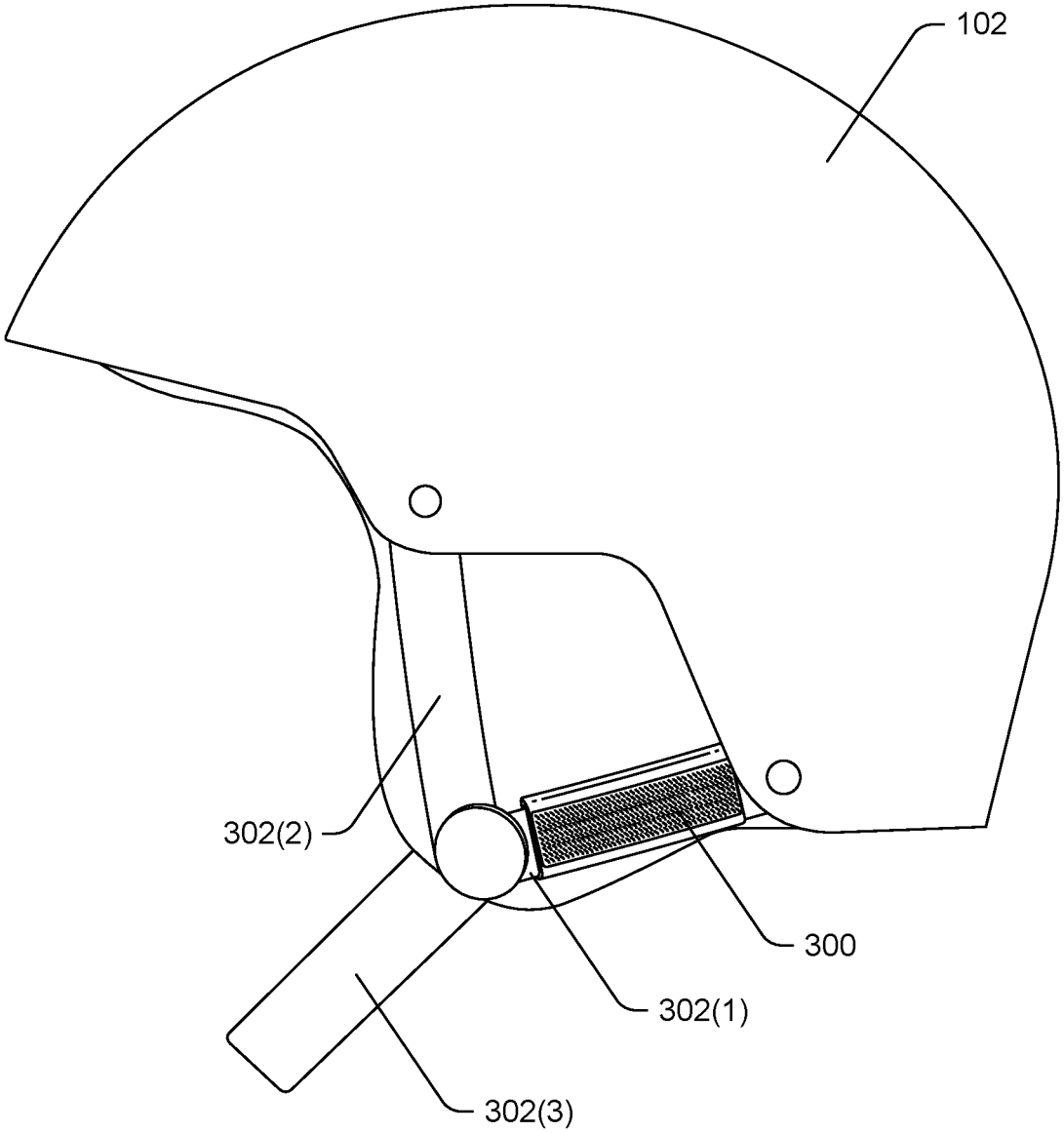
FIG. 4 is a side view of an example band usable with the example face mask of FIG. 1, showing the band wrapped around a strap of the helmet.

FIG. 4 illustrates a side view of the band 300 coupled to the strap 302 of the helmet 102. As shown, the band 300 may wrap around the strap 302.

Additionally, as mentioned previously, the strap 302 may couple to other portions or locations on the helmet 102, thereby allowing the band 300 to be located or disposed at or along other positions than that shown in FIG. 4. For instance, the band 300 may wrap around the strap 302(3) and/or may follow a trajectory or curvature of the strap 302(3).

Figure 5B:
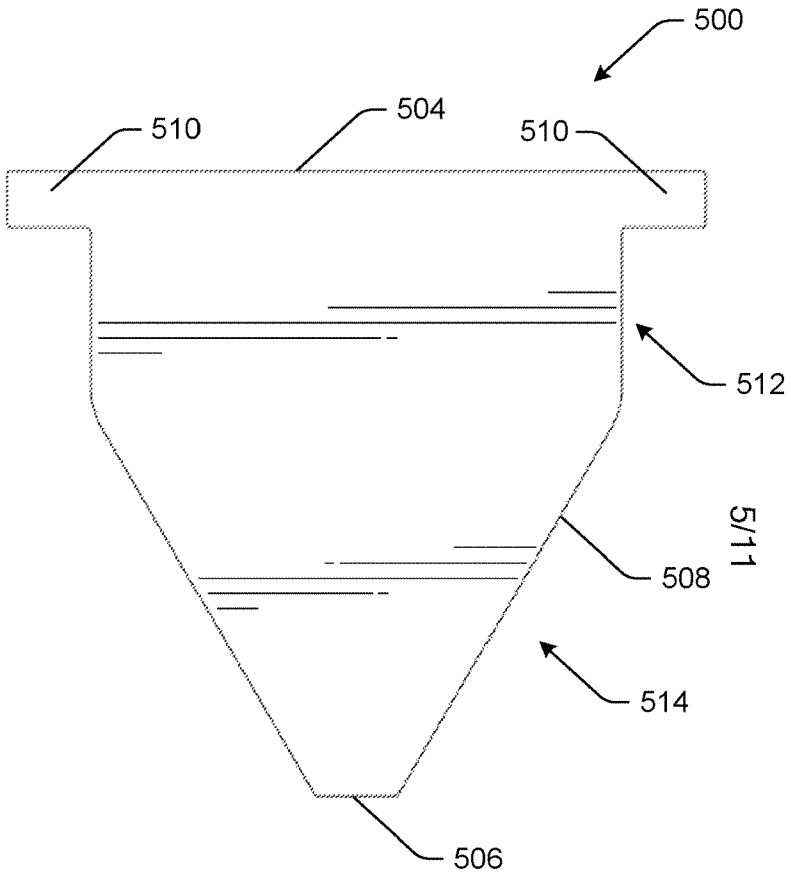
FIG. 5B is a front view of the example face mask of FIG. 5A usable as the example face mask of FIG. 1.
Figure 5A:
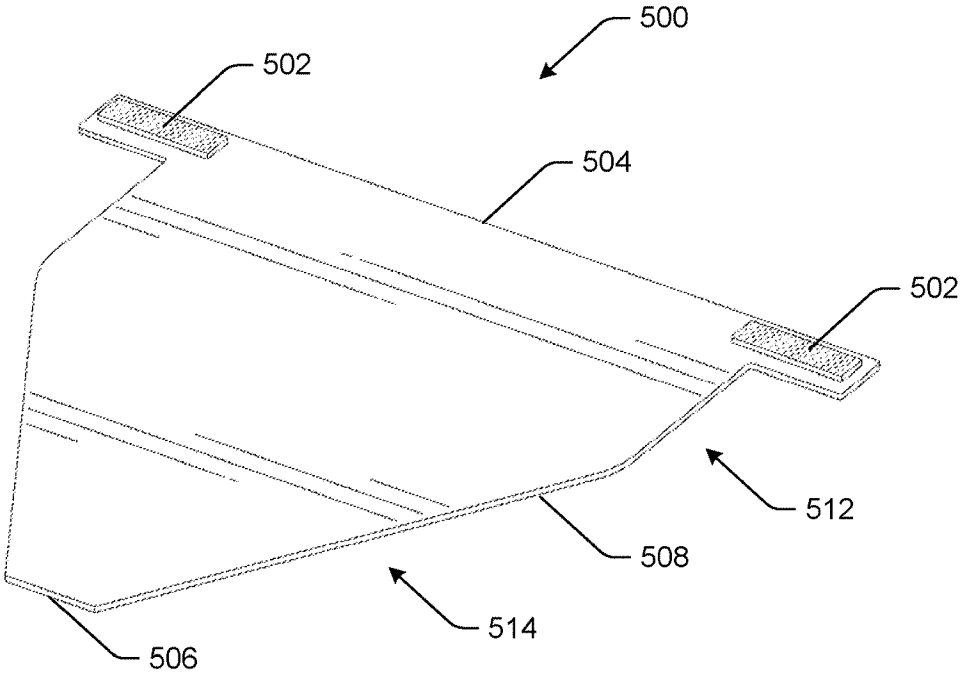
FIG. 5A is a perspective view of an example face mask usable as the example face mask of FIG. 1.

FIGS. 5A and 5B illustrate an example face mask 500. In instances, the face mask 500 may be usable as the face mask 100 and used in conjunction with the band 300, for instance. FIG. 5A illustrates a perspective view of a back or second side of the face mask 500 while FIG. 5B illustrates a plan view of a front or first side of the face mask 500. Beginning with FIG. 5A, the back of the face mask 500 may include attachment mechanisms 502 that couple the face mask 500 to the helmet 102, as discussed in more detail herein. In instances, the attachment mechanisms 502 may attach to bands 300. By way of non-limiting examples, in instances, the attachment mechanisms 502 may include hooks, loops, clips, buckles, magnets, buttons, snap-fits, zippers, etc. In instances, the attachment mechanisms 502 may include similar or different attachment mechanisms.

Turning to the shape of the face mask 500, in instances, the face mask 500 may include a top 504 and a bottom 506. In instances, the top 504 and the bottom 506 may be parallel or substantially parallel to one another. In instances, the top 504 may also have a longer length than a length of the bottom 506. Interposed between the top 504 and the bottom 506 may be sides 508. In instances, the sides 508 may include flanges 510. The flanges 510 may act as a grasping point to attach and/or remove the face mask 500 from the band 300. In instances, the attachment mechanisms 502 may be completely or partially disposed on the flanges 510.

Additionally, or alternatively, the sides 508 may be tapered, chamfered, rounded, or may be straight, curved, boxed, or any combination thereof. For instance, shown in FIGS. 5A and 5B, a first portion 512 of the sides 508 may be perpendicular to the top 504 and/or the flanges 510 while a second portion 514 may be tapered between an end of the first portion 512 and the bottom 506. Between the first portion 512 and the second portion 514, the sides 508 may be rounded, so as to not chafe or irritate the neck of a user. In instances, the taper of the second portion 514 may allow the face mask 500 to comfortably tuck into or beneath other garments, such as a coat, and/or may reduce the bulkiness of the face mask 500.

Figure 6B:
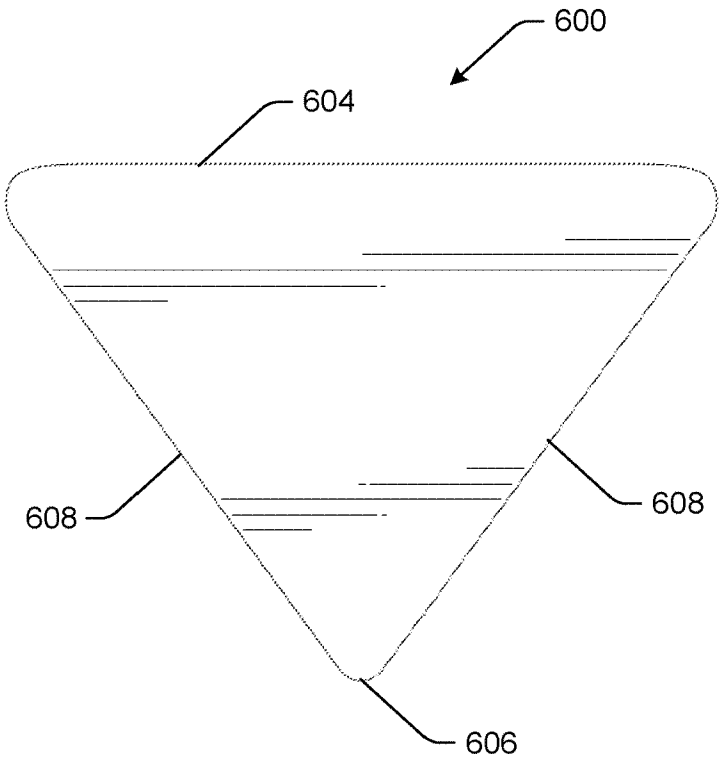
FIG. 6B is a front view of the example face mask of FIG. 6A usable as the example face mask of FIG. 1.
Figure 6A:
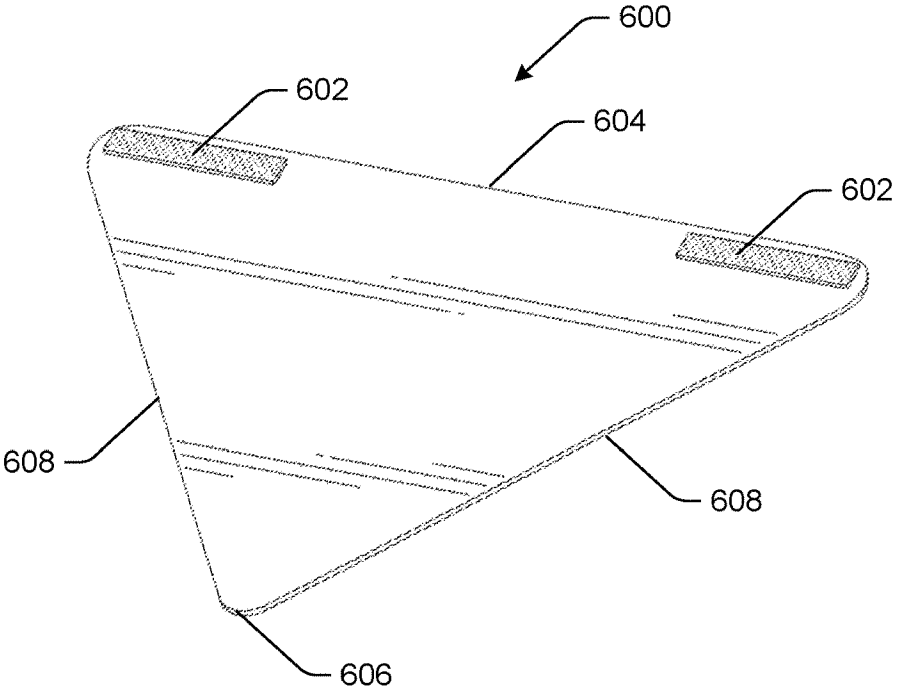
FIG. 6A is a perspective view of another example face mask usable as the example face mask of FIG. 1.

FIGS. 6A and 6B illustrate a face mask 600. In instances, the face mask 600 may be usable as the face mask 100 and in conjunction with the band 300, for instance. FIG. 6A illustrates a perspective view of a back or second side of the face mask 600 while FIG. 6B illustrates a plan view of a front or first side of the face mask 600. Beginning with FIG. 6A, the back of the face mask 600 may include attachment mechanisms 602 that may couple the face mask 600 to the helmet 102, as discussed in more detail herein. In instances, the attachment mechanisms 602 may respectively attach to one of the first band 200 or the second band 202. By way of non-limiting examples, in instances, the attachment mechanisms 602 may include any of the attachment mechanisms discussed above with regards to the attachment mechanisms 502.

Turning to the shape of the face mask 600, in instances, the face mask 600 may include a triangular-shaped profile. The attachment mechanisms 602 may be located at or along a top 604 of the face mask 600. Opposite the top 604 may be a bottom 606, which in some instances, may come to a point or may be rounded. In instances, sides 608 of the face mask 600 may be disposed between the top 604 and the bottom 606 and may include a constant taper or angle between the top 604 and the bottom 606. Additionally, or alternatively, the sides 608 may be curved or boxed.

Figure 7B:
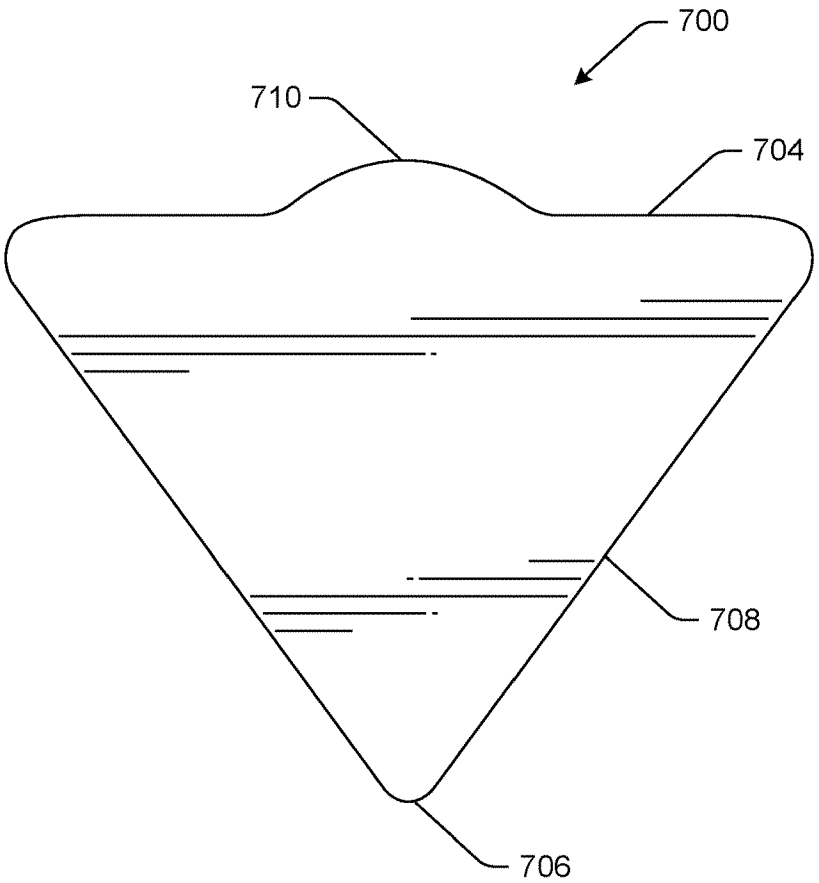
FIG. 7B is a front view of the example face mask of FIG. 7A usable as the example face mask of FIG. 1.
Figure 7A:
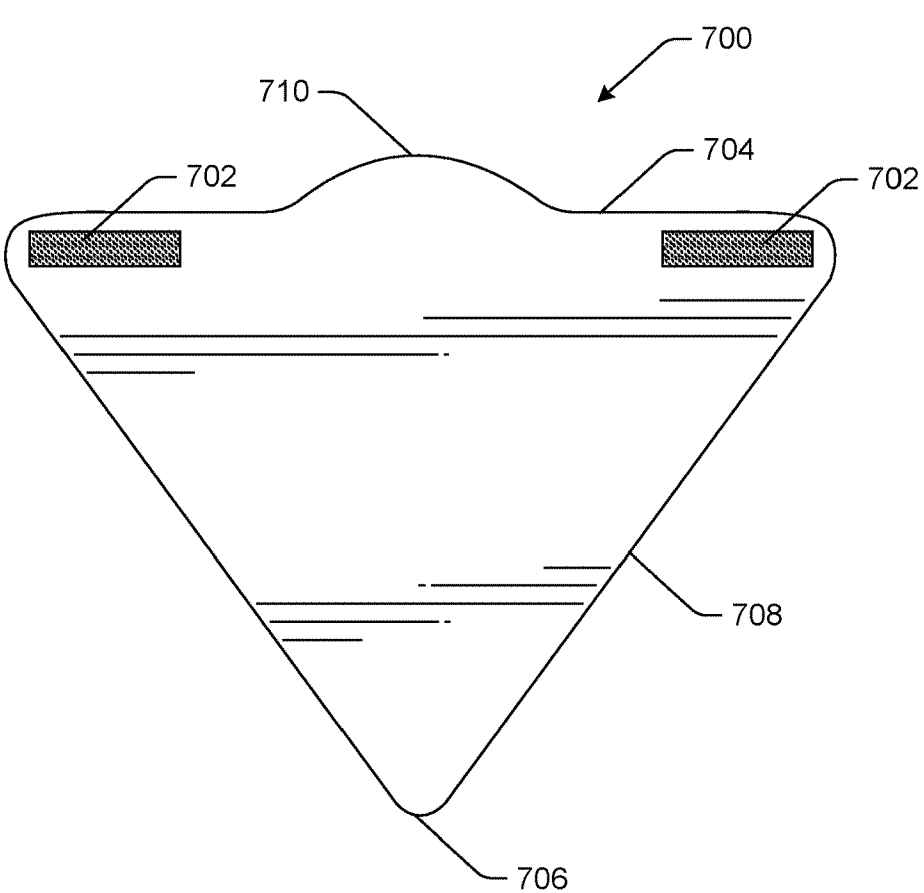
FIG. 7A is a rear view of another example face mask usable as the example face mask of FIG. 1.

FIGS. 7A and 7B illustrate an example face mask 700. In instances, the face mask 700 may be usable as the face mask 100 and used in conjunction with the band 300, for instance. FIG. 7A illustrates a back or second side of the face mask 700 while FIG. 7B illustrates a front or first side of the face mask 700. Beginning with FIG. 7A, the back of the face mask 700 may include attachment mechanisms 702 that couple the face mask 700 to the helmet 102. In instances, the attachment mechanisms 702 may respectively attach to one of the first band or the second band (e.g., the band 300) that are disposed on opposing sides of the helmet 102. By way of non-limiting examples, in instances, the attachment mechanisms 702 may include any of the attachment mechanisms discussed above with regards to the attachment mechanisms 502.

The face mask 700 may include a top 704 and a bottom 706. Interposed between the top 704 and the bottom 706 may be sides 708. In instances, the sides 708 may taper between the top 704 and the bottom 706.

The top 704 may also include a hump 710 or other protrusion that extends from the top 704. In instances, when the face mask 700 is coupled to the helmet 102, the hump 710 may be designed to lay over a nose of the user.

Figure 8B:
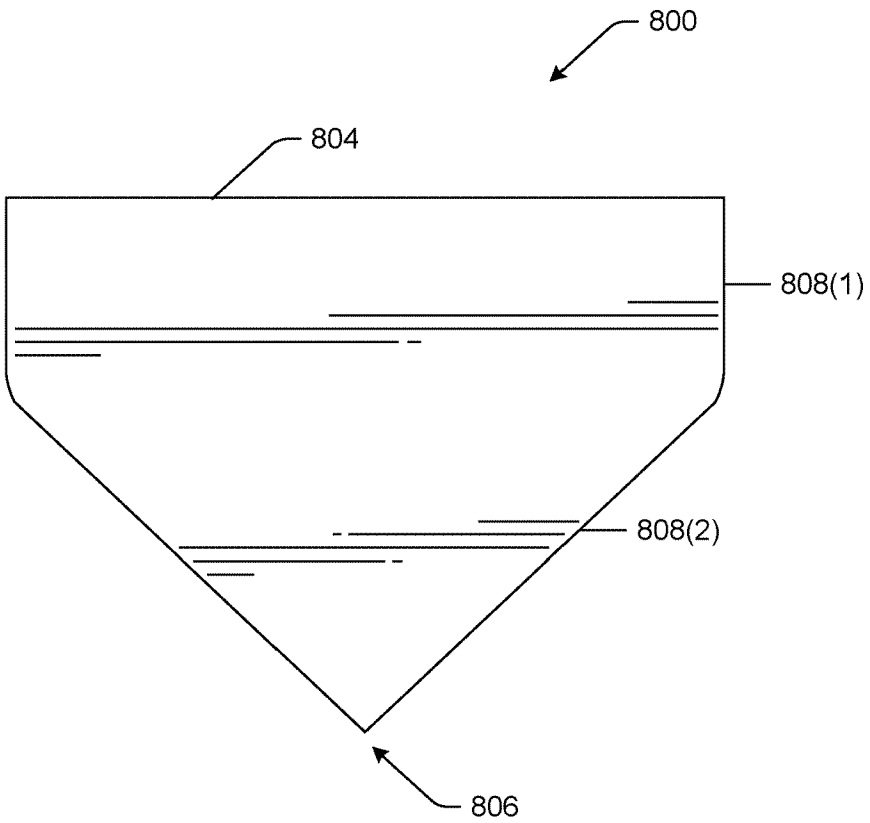
FIG. 8B is a front view of the example face mask of FIG. 8A usable as the example face mask of FIG. 1.
Figure 8A:
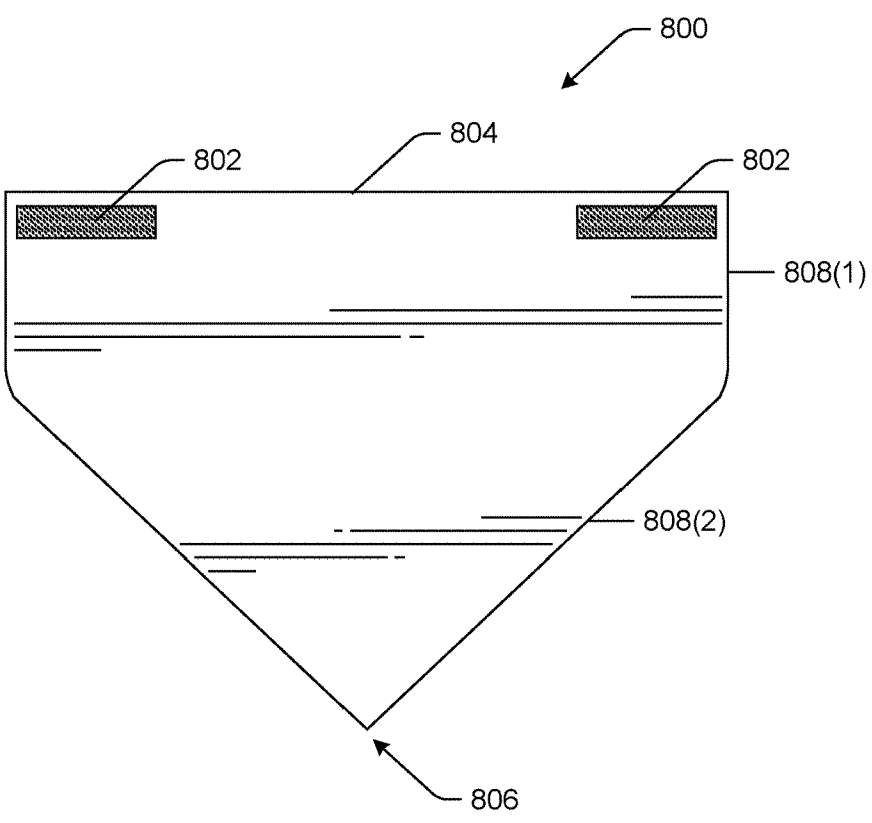
FIG. 8A is a rear view of another example face mask usable as the example face mask of FIG. 1.

FIGS. 8A and 8B illustrate a face mask 800. In instances, the face mask 800 may be usable as the face mask 100 and in conjunction with the band 300, for instance. FIG. 8A illustrates a back or second side of the face mask 800 while FIG. 8B illustrates a front or first side of the face mask 800. Beginning with FIG. 8A, the back of the face mask 800 may include attachment mechanisms 802 that couple the face mask 800 to the helmet 102. In instances, the attachment mechanisms 802 may respectively attach to one of the first band or the second band. By way of non-limiting examples, in instances, the attachment mechanisms 802 may include any of the attachment mechanisms discussed above with regards to the attachment mechanisms 502.

The face mask 800 may include a top 804 and a bottom 806, which in instances, may come to a point or may be rounded. The attachment mechanisms 802 may be located at or along the top 804 of the face mask 800. Sides 808(1) and 808(2) may be interposed between the top 804 and the bottom 806. In instances, the side 808(1) may be perpendicular to the top 804, while the side 808(2) may taper from the side 808(1) to the bottom 806. The intersection between the side 808(1) and the side 808(2) may be rounded.

Although the face mask 500, the face mask 600, the face mask 700, and the face mask 800 have been illustrated and discussed hereinabove, other face masks may be included and/or the face mask 100, the face mask 500, the face mask 600, the face mask 700, and the face mask 800 may include different shapes, designs, or configurations than those shown or features of the face mask 500, the face mask 600, the face mask 700, and the face mask 800 may be integrated or combinable with one another.

Figure 9:
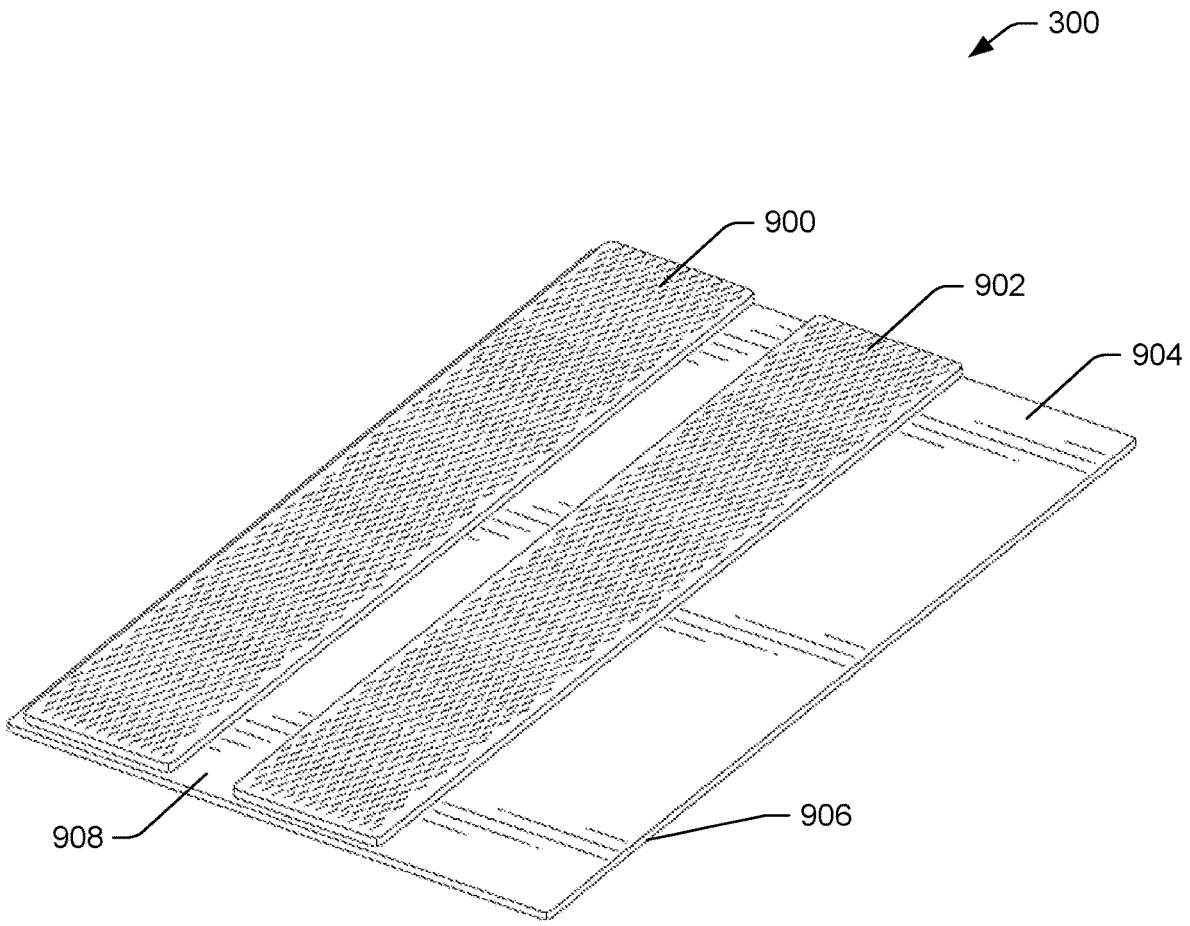
FIG. 9 is a perspective view of the example band usable with the example face mask of FIG. 1, showing the example band in an unfolded configuration.

FIG. 9 illustrates the band 300 including a first attachment mechanism 900 and a second attachment mechanism 902 disposed on a first side 904 of a substrate 906 of the band 300. In instances, the band 300 may be implemented or usable as either or both of the first band or the second band as discussed herein above. In instances, the attachment mechanisms 502, 602, and/or 702 may be configured to attach to the second attachment mechanism 902. In examples, the attachment mechanisms 502, 602, and/or 702 may be smaller than the second attachment mechanism 902.

The first attachment mechanism 900 and the second attachment mechanism 902 may include hooks, Velcro, loops, magnets, clips, buckles, buttons, zippers, or other fasteners that are used to secure the band 300 to the strap 302 and/or the face mask 100 to the band 300. That is, while FIG. 9 illustrates the first attachment mechanism 900 and the second attachment mechanism 902 including particular attachment mechanisms, other configurations may be used.

In instances, the first attachment mechanism 900 and the second attachment mechanism 902 may have similar or different attachment mechanisms. For instance, the first attachment mechanism 900 and the second attachment mechanism 902 may both include hook attachment mechanisms or the first attachment mechanism 900 may include a hook attachment mechanism while the second attachment mechanism 902 may include a loop attachment mechanism.

In instances, the first attachment mechanism 900 and the second attachment mechanism 902 may attach, mount, or couple to the substrate 906. For instance, the substrate 906 may include cotton, nylon, leather, polyester, other fabrics, or any combination or blend thereof, to which the first attachment mechanism 900 and the second attachment mechanism 902 are sewn, stamped, pressed, pinned, or coupled.

As shown in FIG. 9, the first attachment mechanism 900 and the second attachment mechanism 902 may span a length or substantially an entire length of the substrate 906. In addition, the first attachment mechanism 900 and the second attachment mechanism 902 may be spaced apart along the first side 904 by a gap 908. As such, the first attachment mechanism 900 and the second attachment mechanism 902 may be separated by portions of the first side 904. As discussed herein, the gap 908 between the first attachment mechanism 900 and the second attachment mechanism 902 may allow the band 300 to bend or fold along an axis of the gap 908. That is, as less material of the band 300 may occupy the gap 908, the substrate 906 and therefore the gap 908, may be permitted to fold or may more easily fold along the gap 908, thereby allowing the band to wrap around the strap 302 of the helmet 102.

In instances, the first attachment mechanism 900 and the second attachment mechanism 902 may be disposed on portions or sections of the substrate 906. By way of a non-limiting example, the first side 904 of the substrate 906 may include three sections or portions that fold over one another, acting as a trifold. In instances, the first attachment mechanism 900 and the second attachment mechanism 902 may be disposed in the first portion and the second portion, respectively, with the third portion being vacant or not including an attachment mechanism. However, while three sections have been described, more or less than three portions may be included on the first side 904 of the substrate 906.

Figure 10A:
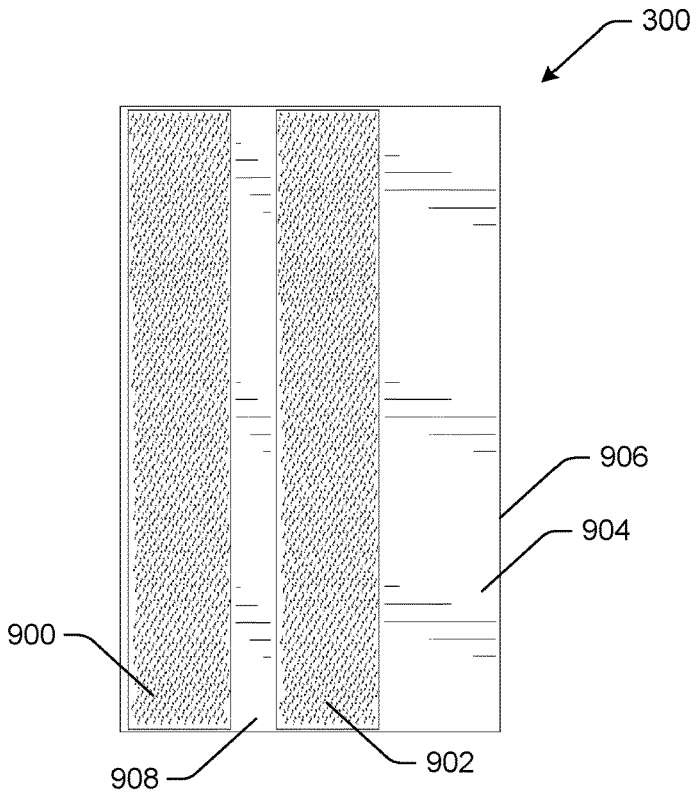
FIG. 10A is a front view of the example band of FIG. 9 usable with the example face mask of FIG. 1, showing the example band in an unfolded configuration.
Figure 10B:
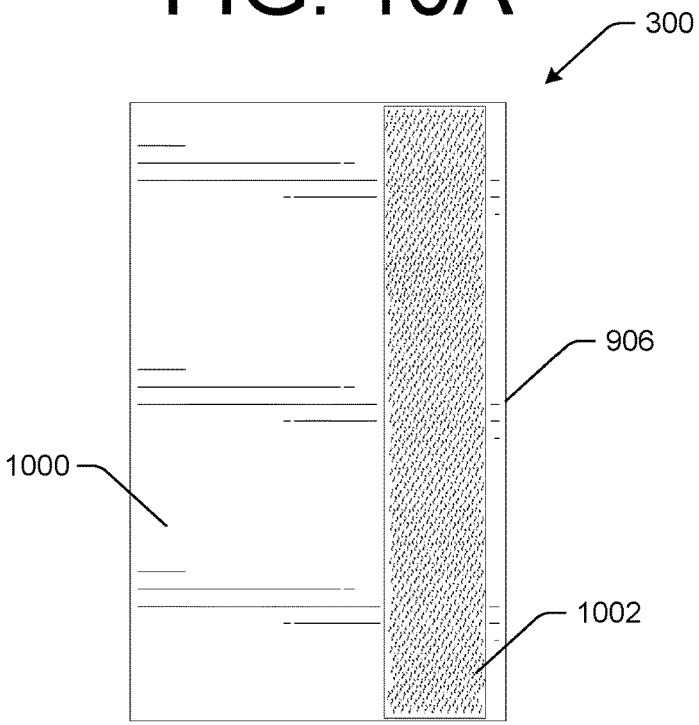
FIG. 10B is a back view of the example band of FIG. 9 usable with the example face mask of FIG. 1, showing the example band in an unfolded configuration.

FIGS. 10A and 10B illustrate front and back views of the band 300, respectively. FIG. 10A illustrates the first side 904 of the substrate 906 of the band 300 while FIG. 10B illustrates a second side 1000 of the substrate 906 of the band 300. In instances, the second side 1000 may be opposite the first side 904. On the second side 100, the band 300 may include a third attachment mechanism 1002. In instances, the third attachment mechanism 1002 may include those attachment mechanisms listed above with regards to the first attachment mechanism 900 or the second attachment mechanism 902 and may be attached to the substrate 906 similar to those listed above with regards to the first attachment mechanism 900 and the second attachment mechanism 902. Moreover, in instances, the third attachment mechanism 1002 may span an entire length of width of the second side 1000 of the substrate 906 or may span less than an entire length of width.

In instances, the second side 1000 of the substrate 906 may include sections or portions. For instance, the second side 1000 may include three portions, with the third attachment mechanism 1002 being disposed in a third portion. In instances, the third portion of the second side 1000 may be opposite the third portion of the first side 904 of the substrate 906. Therefore, in instances, the third attachment mechanism 1002 may not be directly opposite to the first attachment mechanism 900 or the second attachment mechanism 902 on the first side 904.

In instances, the third attachment mechanism 1002 may be configured or may be complimentary to engage with the first attachment mechanism 900 when the band 300 is folded. That is, when the band 300 is folded around the strap 302, along, for instance, the gap 908, the third attachment mechanism 1002 and the first attachment mechanism 900 may engage or couple to one another such that the band 300 couples to the strap 302. By way of a non-limiting example, when the first attachment mechanism 900 includes a hook attachment mechanism, the third attachment mechanism 1002 may include loop attachment mechanisms that engages with the hook attachment mechanism. Alternatively, or additionally, the first attachment mechanism 900 and the third attachment mechanism 1002 may engage via oppositely attracted magnets. In doing so, the band 300 may be coupled to the strap 302 of the helmet 102 as shown in FIGS. 1-4.

Figure 11C:
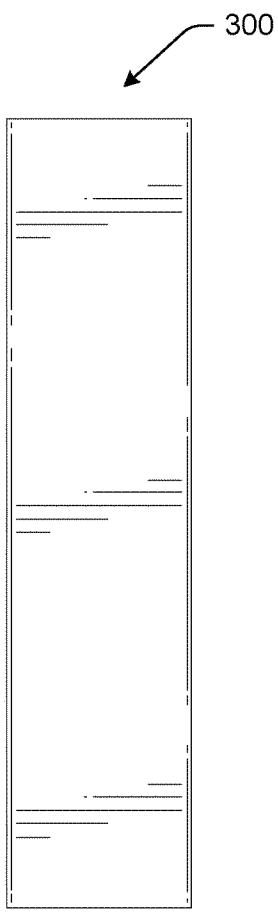
FIG. 11C is a back view of the example band of FIG. 9 usable with the example helmet face mask of FIG. 1, showing the example band in a folded configuration.
Figure 11B:
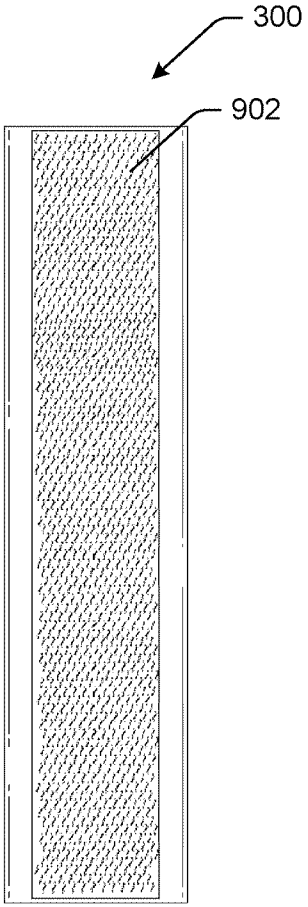
FIG. 11B is a front view of the example band of FIG. 9 usable with the example face mask of FIG. 1, showing the example band in a folded configuration.
Figure 11A:
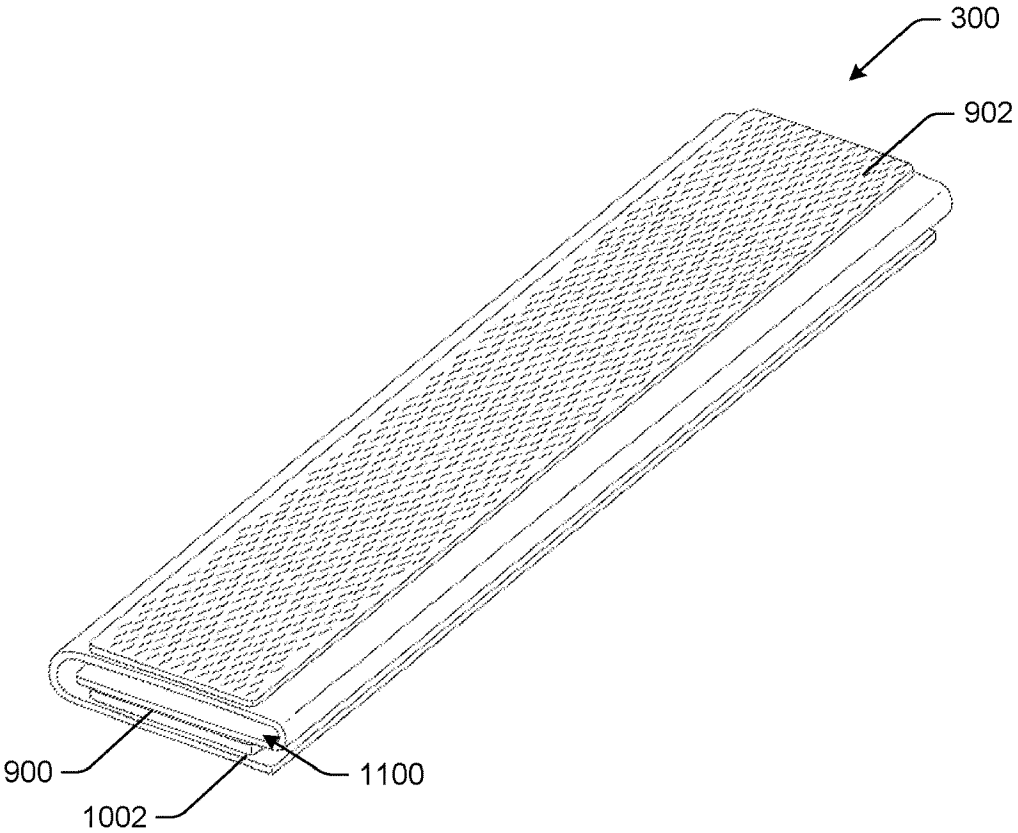
FIG. 11A is a perspective view of the example band of FIG. 9 usable with the example face mask of FIG. 1, showing the example band in a folded configuration.

FIGS. 11A, 11B, and 11C illustrate perspective, front, and back views of the band 300, respectively. More particularly, FIGS. 11A, 11B, and 11C illustrate the band 300 in a folded configuration. That is, the substrate 906 of the band 300, as shown in FIGS. 9, 10A, and 10B, may fold to create or configure the band 300 as shown in FIGS. 11A, 11B, and 11C.

To fold the substrate 906 and configure the band 300 in the folded arrangement, the first attachment mechanism 902 may be folded over such that portions of the second side 1000 of the substrate 906 are opposed to one another. For instance, the substrate 906 may be folded about the gap 908 such that the first attachment mechanism 900 and the third attachment mechanism 1002 are disposed or facing in the same direction. That is, the first attachment mechanism 900 and the third attachment mechanism 1102 may be adjacent to one another such that the third attachment mechanism 1102 may be fold over and come into contact with the first attachment mechanism 900. As such, when brought into contact and given that the first attachment mechanism 900 and the third attachment mechanism 1102 are complementary to couple to one another, the band 300 may retain a folded configuration.

While the band 300 has been described as being folded without the strap 302, as mentioned above, the band 300 may wrap or secure to the strap 302. To illustrate, prior to folding the band 300, the strap 302 may be disposed adjacent to the second side 1000 of the substrate 906 and adjacent to the third attachment mechanism 1102. Thereafter, the substrate 906 and the first attachment mechanism 900 may be folded over such that the strap 302 is interposed between surfaces or portions of the second side 1000. That is, the strap 302 may be interposed between the first attachment mechanism 900 and the second attachment mechanism 902. The third attachment mechanism 1102 may then fold into contact with the first attachment mechanism 900 to secure the band 300 around the strap 302.

In instances, depending on how much the first attachment mechanism 900 and the third attachment mechanism 1102 overlap or adjoin, for instance, the tautness about which the band 300 couples to the strap 302 may be varied.

In instances, and with reference to FIG. 11A, the strap 302 may be disposed through an opening 1100 interposed between the second side 1000 of the substrate 906 when the substrate 906 is folded. The opening 1100 may span the length of the band 300 such that the strap 302 may pass therethrough.

Shown in in FIGS. 11A and 11B, after the substrate 904 is folded, the second attachment mechanism 902 may be exposed. The attachment mechanisms on the face mask 100 (e.g., the attachment mechanisms 502, the attachment mechanisms 602, the attachment mechanisms 702, or attachment mechanism 802) may therefore engage with the second attachment mechanism 902. The attachment mechanisms on the face mask 100 may be complimentary to engage with the second attachment mechanism 902 to secure the face mask 100 to the helmet 102.

While the band 300 has been described hereinabove, that when folded, the second attachment mechanism 902 may be exposed on an exterior (e.g., the first side 904), in instances the band 300 may include different configurations. For instance, the band 300 may include sleeves into which magnets or other attachment mechanism are disposed. In turn, in instances, the second attachment mechanism 902 may not be visible on the exterior of the band 300. Additionally, or alternatively, in some instances, such as when the second attachment mechanism 904 includes magnets, the magnets may be disposed on the second side 1000 of the substrate 904 and may include enough magnetic strength to couple the face mask 100 to the helmet 102.

CONCLUSION

While various examples and embodiments are described individually herein, the examples and embodiments may be combined, rearranged and modified to arrive at other variations within the scope of this disclosure. In addition, although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

The invention claimed is:

1. A system comprising:

a helmet comprising:

a first strap including:

a first strap portion with a first end affixed to the helmet, a second strap portion with a first end affixed to the helmet, and a third strap portion affixed to a second end of the first strap portion and affixed to a second end of the second strap portion;

a second strap including:

a first strap portion with a first end affixed to the helmet, a second strap portion with a first end affixed to the helmet, and a third strap portion affixed to a second end of the first strap portion and affixed to a second end of the second strap portion;

a first band wrapped entirely around and slidably engaging the first strap portion of the first strap of the helmet and a second band wrapped entirely around and slidably engaging the first strap portion of the second strap of the helmet, each of the first band and the second band including:

a first side having a first attachment mechanism and a second attachment mechanism; and a second side having a third attachment mechanism, wherein the first attachment mechanism releasably engages the third attachment mechanism; and a face mask including:

a first side; and a second side having at least a fourth attachment mechanism and a fifth attachment mechanism, wherein the fourth attachment mechanism is releasably engaged directly with the second attachment mechanism of the first band, and the fifth attachment mechanism is releasably engaged directly with the second attachment mechanism of the second band.

2. The system of claim 1, wherein at least one of the first attachment mechanism, the second attachment mechanism, the third attachment mechanism, the fourth attachment mechanism, or the fifth attachment mechanism includes at least one of:

a hook substrate;

a loop substrate;

a clip; or a magnet.

3. The system of claim 1, wherein the face mask includes at least four layers, and wherein:

the first layer includes polyester;

the second layer includes cotton;

the third layer includes a fabric; and the fourth layer includes a water-resistant material.

4. A system comprising:

a helmet comprising:

a first strap including:

a first strap portion with a first end affixed to the helmet, a second strap portion with a first end affixed to the helmet, and a third strap portion affixed to a second end of the first strap portion and affixed to a second end of the second strap portion;

a second strap including:

a first strap portion with a first end affixed to the helmet, a second strap portion with a first end affixed to the helmet, and a third strap portion affixed to a second end of the first strap portion and affixed to a second end of the second strap portion;

a first band wrapped entirely around and slidably engaging the first strap portion of the first strap of the helmet and a second band wrapped entirely around and slidably engaging the first strap portion of the second strap of the helmet, each of the first band and the second band including:

a first side having at least a first portion, a second portion, and a third portion, wherein the first portion has a first attachment mechanism and the second portion has a second attachment mechanism; and a second side having at least a first portion, a second portion, and a third portion, wherein the third portion of the second side is opposite the third portion of the first side, and wherein the third portion has a third attachment mechanism, wherein the third attachment mechanism releasably engages the first attachment mechanism; and a face mask including a first side and a second side, the second side having fourth attachment mechanisms, wherein each of the fourth attachment mechanisms is releasably engaged directly with a respective one of the second attachment mechanism of the first and second bands.

5. The system of claim 4, wherein the fourth attachment mechanisms are spaced apart on the second side of the face mask.

6. The system of claim 4, wherein the face mask includes:

a top;

a bottom parallel to the top; and sides disposed between the top and the bottom, the sides having: a flange; and a tapered sidewall disposed interior to the flange.

7. The system of claim 6, wherein the fourth attachment mechanisms are disposed on the flange.

8. The system of claim 4, wherein the face mask includes:

a top;

a bottom; and sides having:

a first portion perpendicular to the top; and a second portion tapering between the first portion and the bottom.

9. The system of claim 4, wherein the face mask is triangular-shaped.

10. The system of claim 4, wherein the third portion of the first side of at least one of the first band or the second band includes at least one of leather, felt, or cotton.

* * * * *